US008695647B2

(12) United States Patent
Ruble

(10) Patent No.: US 8,695,647 B2
(45) Date of Patent: Apr. 15, 2014

(54) CAM APPARATUS FOR A BEVERAGE FILLING ASSEMBLY

(75) Inventor: Edwin K. Ruble, Parkton, MD (US)

(73) Assignee: Adcor Industries, Inc., Baltimore, MD (US)

( * ) Notice: Subject to any disclaimer, the term of this patent is extended or adjusted under 35 U.S.C. 154(b) by 110 days.

(21) Appl. No.: 13/221,085

(22) Filed: Aug. 30, 2011

(65) Prior Publication Data

US 2011/0303326 A1 Dec. 15, 2011

Related U.S. Application Data

(63) Continuation of application No. 12/838,068, filed on Jul. 16, 2010, now abandoned.

(60) Provisional application No. 61/271,151, filed on Jul. 17, 2009.

(51) Int. Cl.
*B65B 43/42* (2006.01)

(52) U.S. Cl.
USPC ..... 141/147; 141/57; 141/144; 141/145; 141/146

(58) Field of Classification Search
USPC ..... 141/57, 144–147
See application file for complete search history.

(56) References Cited

U.S. PATENT DOCUMENTS 3,463,203 A * 8/1969 Wolf ..... 141/39
4,089,353 A * 5/1978 Antonelli ..... 141/302
4,349,055 A * 9/1982 DiChiara ..... 141/39
4,369,821 A 1/1983 Carter
4,371,220 A * 2/1983 Brucher ..... 384/371
4,526,197 A * 7/1985 Martin et al. ..... 137/596.2
4,979,546 A * 12/1990 LaWarre et al. ..... 141/286
5,119,853 A * 6/1992 Petri et al. ..... 141/39
5,150,740 A * 9/1992 Yun ..... 141/6
5,295,520 A * 3/1994 Acker ..... 141/39
5,586,379 A 12/1996 Nish
5,642,764 A 7/1997 Nish
5,884,677 A 3/1999 McKaughan
5,924,462 A 7/1999 McKaughan

OTHER PUBLICATIONS

Webpage entitled "Greaseless Actuator" from the Technical Beverage Services website; http://technicalbeverageservices.com/greaseless-actuator.html; dated Oct. 29, 2010; 1 page.

(Continued)

*Primary Examiner* — Timothy L Maust
(74) *Attorney, Agent, or Firm* — Howard & Howard Attorneys PLLC

(57) ABSTRACT

A beverage filling assembly and a cam apparatus for a beverage filling machine is disclosed. A cam housing defines a first aperture along a central axis and a second aperture transverse to the central axis with a filling valve aligned with the second aperture. The cam member is rotatably disposed in the first aperture and includes a shaft portion and an eccentric portion aligning with the filling valve. A lever is connected to the cam member for concurrent movement with the cam member. A bearing sleeve defines an orifice for receiving the shaft portion. The bearing sleeve is formed of a self-lubricating material for preventing frictional engagement between the cam housing and the shaft portion. The bearing sleeve includes a flange adjacent the cam housing for preventing movement of the bearing sleeve axially along the central axis during operation. The bearing sleeve is removable from the shaft portion during servicing.

27 Claims, 6 Drawing Sheets

(56) References Cited

OTHER PUBLICATIONS

Webpage entitled "TBS H&K Valve Trip" from the Technical Beverage Services website; http://technicalbeverageservices.com/tbs-hak-valve-trip.html; dated Oct. 6, 2010; 1 page.
U.S. Appl. No. 11/286,660; no copy of application is currently available; 0 page.
Webpage entitled "Filler Valves" from the Bevcorp LLC website; http://www.bevcorp.com/valves; dated Sep. 8, 2010; 1 page.
Webpage entitled "TBS 1" from the Internet Archive Wayback Machine website regarding Technical Beverage Services website; http://web.archive.org/web/20080412023321/www.technicalbeverageservices.com/greaseless.htm; dated Mar. 10, 2008; 1 page.

* cited by examiner

CAM APPARATUS FOR A BEVERAGE FILLING ASSEMBLY

CROSS REFERENCE TO RELATED APPLICATIONS

This application is a continuation of co-pending U.S. Non-Provisional Application Ser. No. 12/838,068 filed on Jul. 16, 2010, which claims the benefit of U.S. Provisional Patent Application Ser. No. 61/271,151 filed on Jul. 17, 2009, the disclosures of which are hereby incorporated by reference.

BACKGROUND OF THE INVENTION

1. Field of the Invention

The subject invention generally relates to a beverage filling assembly for filling a container with fluid.

2. Description of the Prior Art

Beverage filling machines are known in the art for filling a container with fluid. One type of beverage filling machine utilizes grease to lubricate between moving components. This type of beverage filling machine typically includes a cam assembly having a housing and a cam rotatably disposed within the housing. A liner is disposed about a portion of the cam between the housing and the cam. The cam defines a plurality of channels and a grease fitting screw is connected to the cam and cooperates with the channels. For example, grease is inserted through the grease fitting screw and into the channels of the cam such that grease is injected between the cam and the housing for reducing frictional wear therebetween. However, utilizing grease increases the potential for contaminating fluid during the filling process of the beverage filling machine.

Therefore, there remains an opportunity to develop a beverage filling assembly and cam apparatus which eliminates the need for utilizing grease between a cam housing and a cam member.

SUMMARY OF THE INVENTION AND ADVANTAGES

The subject invention provides for a beverage filling assembly for filling a container with fluid. The assembly includes a filling valve movable between a filling position for allowing fluid to flow into the container and a non-filling position for preventing fluid from flowing into the container. The assembly also includes a cam housing defining a first aperture axially along a central axis and a second aperture transverse to the central axis with the filling valve aligned with the second aperture. The assembly further includes a cam member rotatably disposed in the first aperture. The cam member includes a shaft portion and an eccentric portion coupled to the shaft portion with the eccentric portion aligning with the filling valve for moving the filling valve between the filling and non-filling positions. The assembly includes a lever connected to the cam member for concurrent movement with the cam member to actuate the cam and the filling valve between the filling and non-filling positions. The assembly further includes a bearing sleeve defining an orifice axially along the central axis for receiving the shaft portion. The bearing sleeve is disposed between the shaft portion and the cam housing with the bearing sleeve formed of a self-lubricating material for preventing frictional engagement between the cam housing and the shaft portion as the cam member moves within the cam housing. The bearing sleeve includes a flange adjacent the cam housing for preventing movement of the bearing sleeve axially along the central axis during operation with the bearing sleeve being removable from the shaft portion during servicing.

The subject invention also provides for a cam apparatus for a beverage filling machine. The apparatus includes the cam housing defining the aperture along the central axis and the cam member disposed in the aperture. The cam member includes the shaft portion with the cam member movable between a first position and a second position. The apparatus also includes the lever connected to the cam member for concurrent movement with the cam member. The apparatus further includes the bearing sleeve defining the orifice along the central axis for receiving the shaft portion such that the bearing sleeve is disposed between the shaft portion and the cam housing. The bearing sleeve is formed of the self-lubricating material for preventing frictional engagement between the cam housing and the shaft portion as the cam member moves between the first and second positions. The bearing sleeve includes the flange adjacent the cam housing for preventing movement of the bearing sleeve axially along the central axis during operation with the bearing sleeve being removable from the shaft portion during servicing.

Therefore, the beverage filling assembly and the cam apparatus provide for the bearing sleeve formed of the self-lubricating material which eliminates the need for utilizing grease as discussed in the background of the invention section. Further, utilizing the bearing sleeve formed of the self-lubricating material also allows numerous components, including the liner, the grease fitting screw, and the channels of the cam as discussed in the background of the invention, to be eliminated. In addition, the bearing sleeve is removable from the shaft portion of the cam member for allowing easy servicing and/or replacing of the cam member and/or bearing sleeve; thus reducing costs.

BRIEF DESCRIPTION OF THE DRAWINGS

Advantages of the present invention will be readily appreciated, as the same becomes better understood by reference to the following detailed description, when considered in connection with the accompanying drawings.

DETAILED DESCRIPTION OF THE INVENTION

Figure 1:
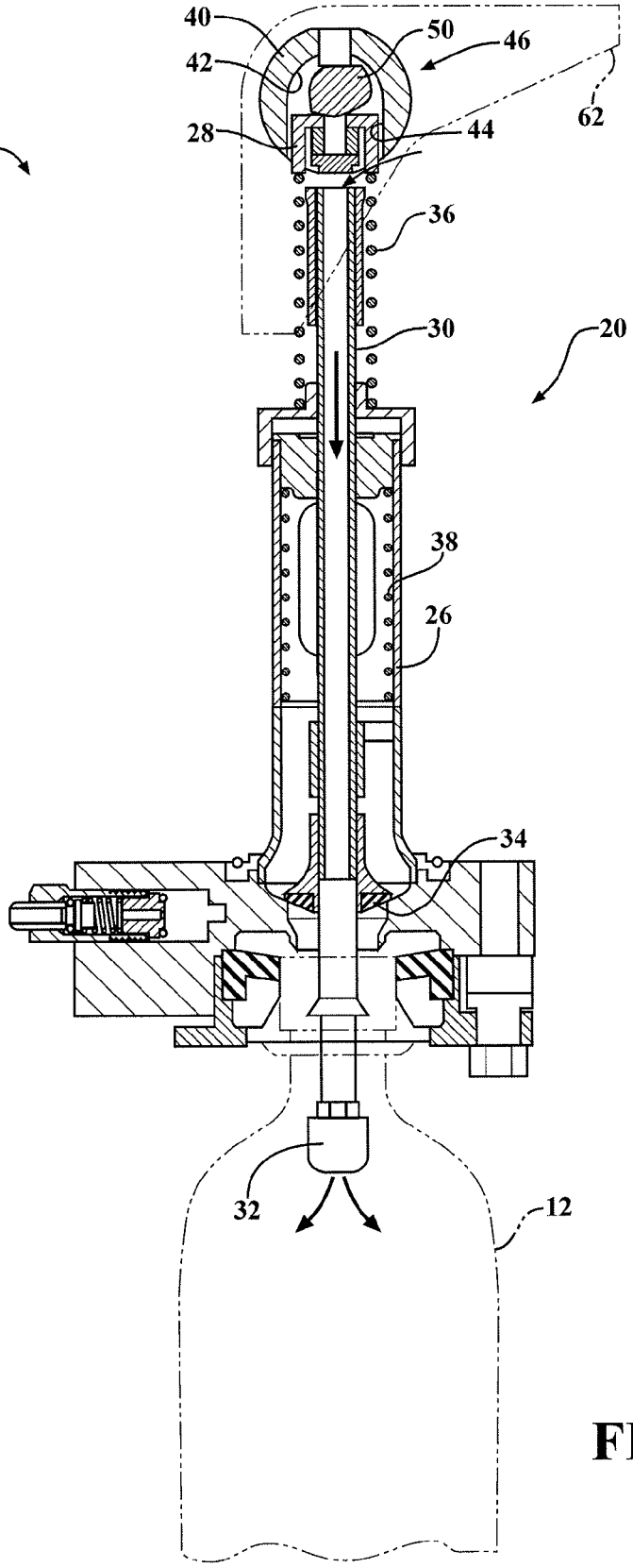
FIG. 1 is a partial cross-sectional view of a beverage filling assembly having a filling valve in a filling position, a cam member in a first position, a lever in an on-position shown in phantom, and a container prior to filling with fluid shown in phantom.
Figure 2:
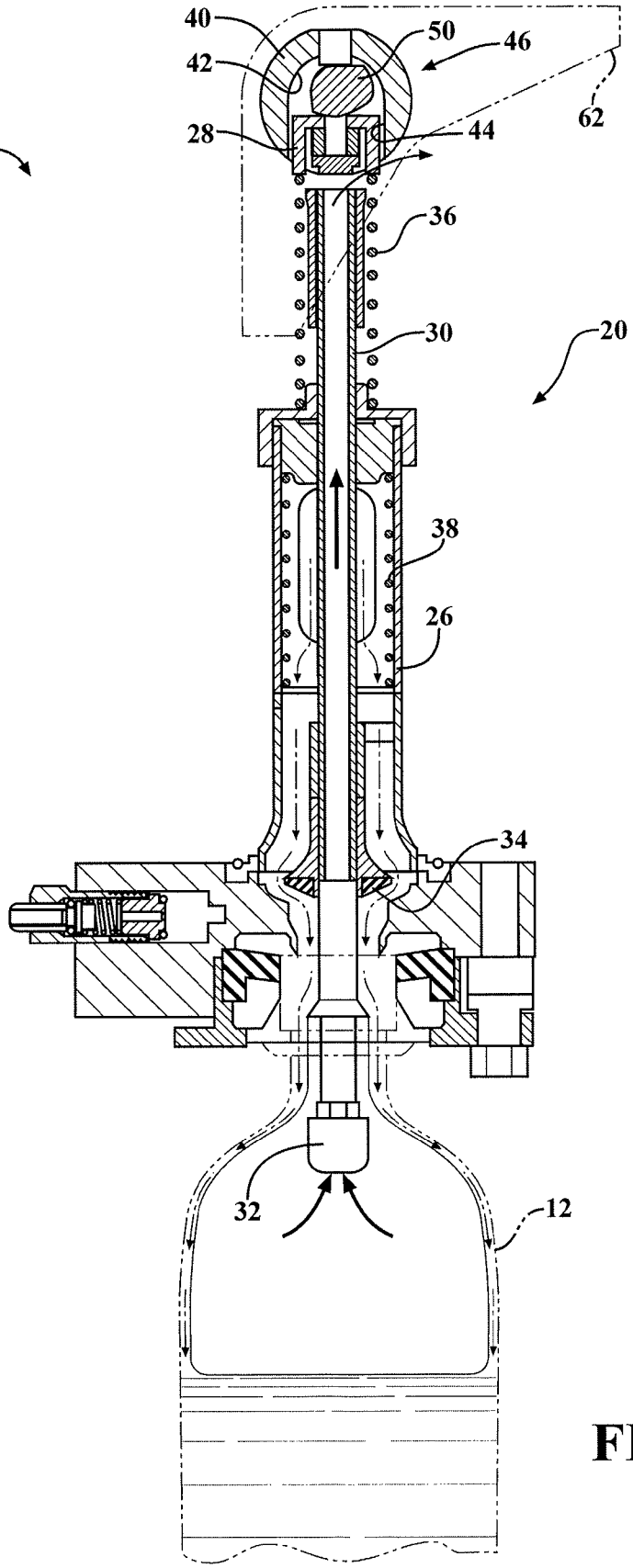
FIG. 2 is a partial cross-sectional view of the beverage filling assembly having the filling valve in the filling position, the cam member in the first position, the lever in the on-position shown in phantom, and the container being filled with fluid shown in phantom.
Figure 3:
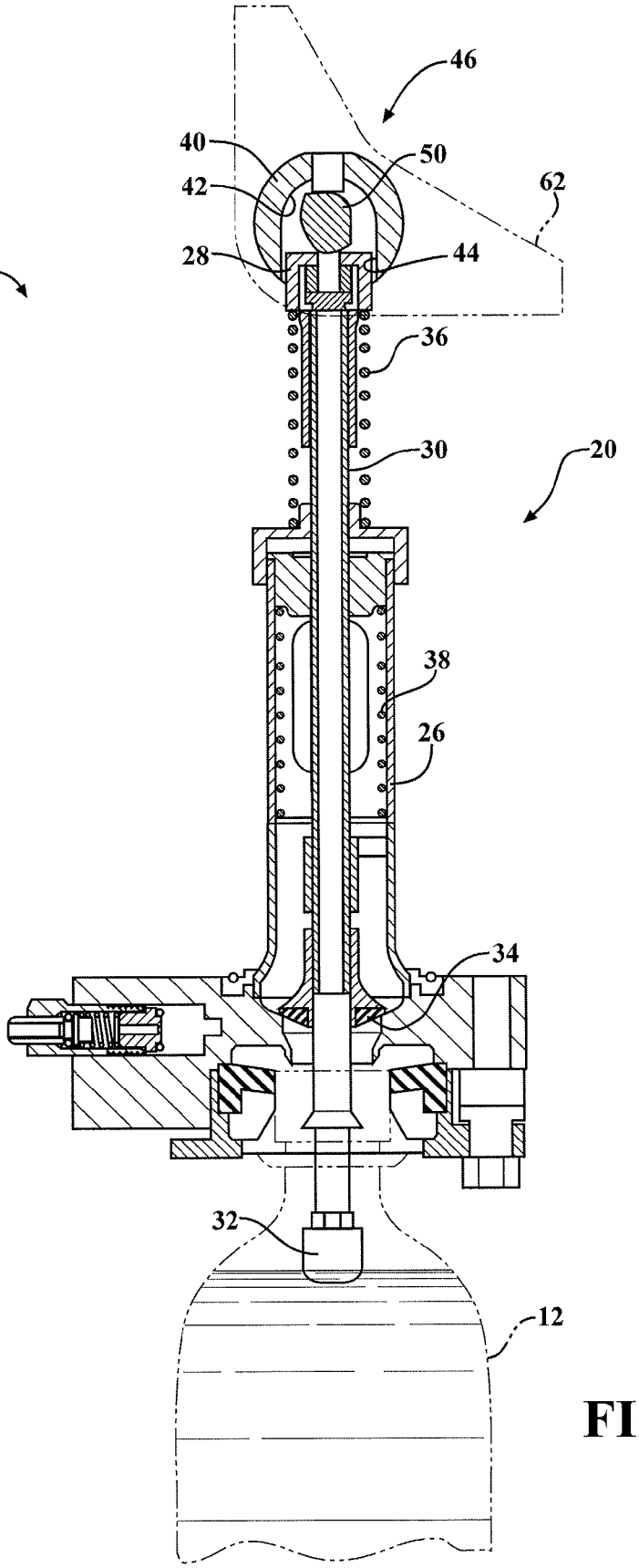
FIG. 3 is a partial cross-sectional view of the beverage filling assembly having the filling valve in a non-filling position, the cam member in a second position, the lever in an off-position shown in phantom, and the container filled with fluid shown in phantom.

Referring to the Figures, wherein like numerals indicate like or corresponding parts throughout the several views, a beverage filling assembly 10 for filling a container 12 with fluid is generally shown in FIGS. 1-3.

The beverage filling assembly 10 includes a beverage filling machine (not shown) having a filling table (not shown) rotatable about a pivot axis. A tank (not shown) is fixed to the filling table such that the tank concurrently rotates with the filling table. The tank stores the fluid that will fill the containers 12. The beverage filling assembly 10 further includes a filling valve 20 movable between a filling position for allowing fluid to flow into the container 12 and a non-filling position for preventing fluid from flowing into the container 12.

The beverage filling machine also includes a plurality of stanchions (not shown) spaced from and fixed relative to the filling table. An arm or rail (not shown) is affixed to each of the stanchions for actuating the filling valve 20 to fill the containers 12 with fluid. It is to be appreciated that the filling valve 20 and the components of the beverage filling machine can be of a variety of different designs without deviating from the scope of the subject invention.

Referring to FIGS. 1-3, the filling valve 20 includes a valve sleeve 26 and a cap 28 supported by the valve sleeve 26. The filling valve 20 further includes a valve stem 30 coupled to the cap 28, a vent tube 32 coupled to the valve stem 30, and a valve seal 34 coupled to the valve sleeve 26. The filling valve 20 also includes a first spring 36 disposed about the valve stem 30 and abutting the cap 28 and a second spring 38 disposed within the valve sleeve 26 to continuously biased the valve sleeve 26 and the valve seal 34 downwardly away from the cap 28. FIGS. 1 and 2 illustrate the filling valve 20 in the filling position and FIG. 3 illustrates the filling valve 20 in the non-filling position. The filling valve 20 includes multiple additional components as known to those skilled in the art which will not be detailed herein.

Figure 4:
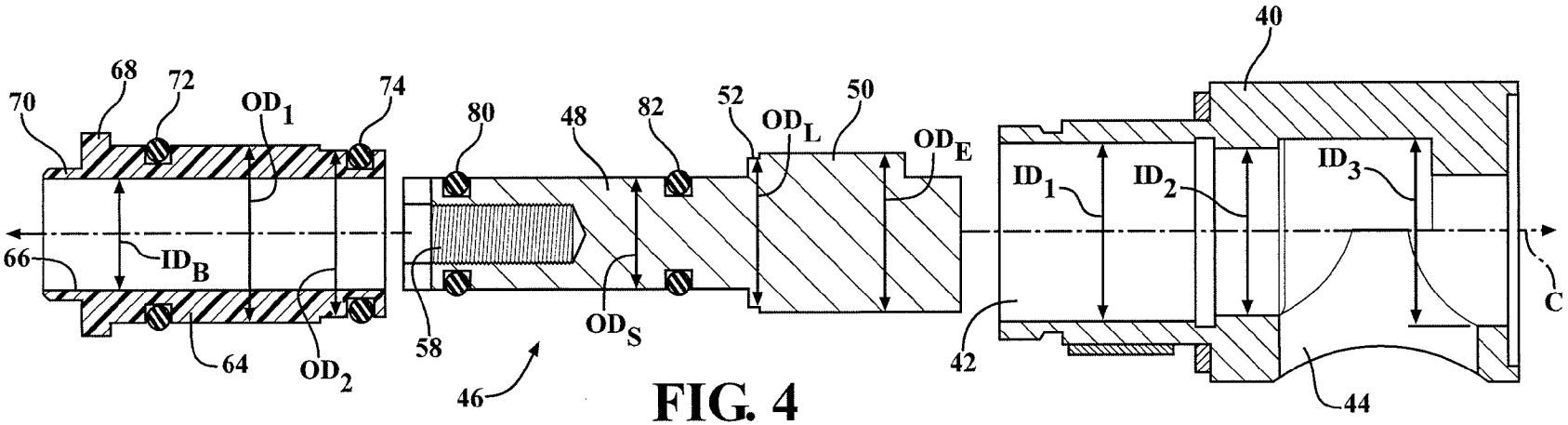
FIG. 4 is an exploded cross-sectional view of a cam housing, the cam member, and a bearing sleeve.

The assembly 10 includes a cam housing 40 coupled to the beverage filling machine. As best shown in FIG. 4, the cam housing 40 defines an aperture 42 axially along a central axis C. The aperture 42 is further defined as a first aperture 42. The housing also defines a second aperture 44 transverse to the central axis C with the filling valve 20 aligned with the second aperture 44. In other words, the second aperture 44 allows for interaction with the filling valve 20. More specifically, the cap 28 aligns with the second aperture 44. In certain embodiments, the cap 28 is at least partially disposed in the second aperture 44.

The first aperture 42 of the cam housing 40 defines a first inner diameter $ID_1$ and a second inner diameter $ID_2$ less than the first inner diameter $ID_1$. The first aperture 42 of the cam housing 40 further defines a third inner diameter $ID_3$ greater than the first and second inner diameter $ID_1$, $ID_2$. The second inner diameter $ID_2$ is disposed between the first and third inner diameters $ID_1$, $ID_3$.

Also referring to FIGS. 1-3, the assembly 10 further includes a cam member 46 rotatably disposed in the first aperture 42 of the cam housing 40 during operation. More specifically, the cam member 46 is movable between a first position and a second position. The cam member 46 is shown in the first position in FIGS. 1 and 2 and the cam member 46 is shown in the second position in FIG. 3. It is to be appreciated that the cam member 46 being disposed in the first aperture 42 includes configurations in which the cam member 46 is partially disposed in the first aperture 42 of the cam housing 40.

Figure 5:
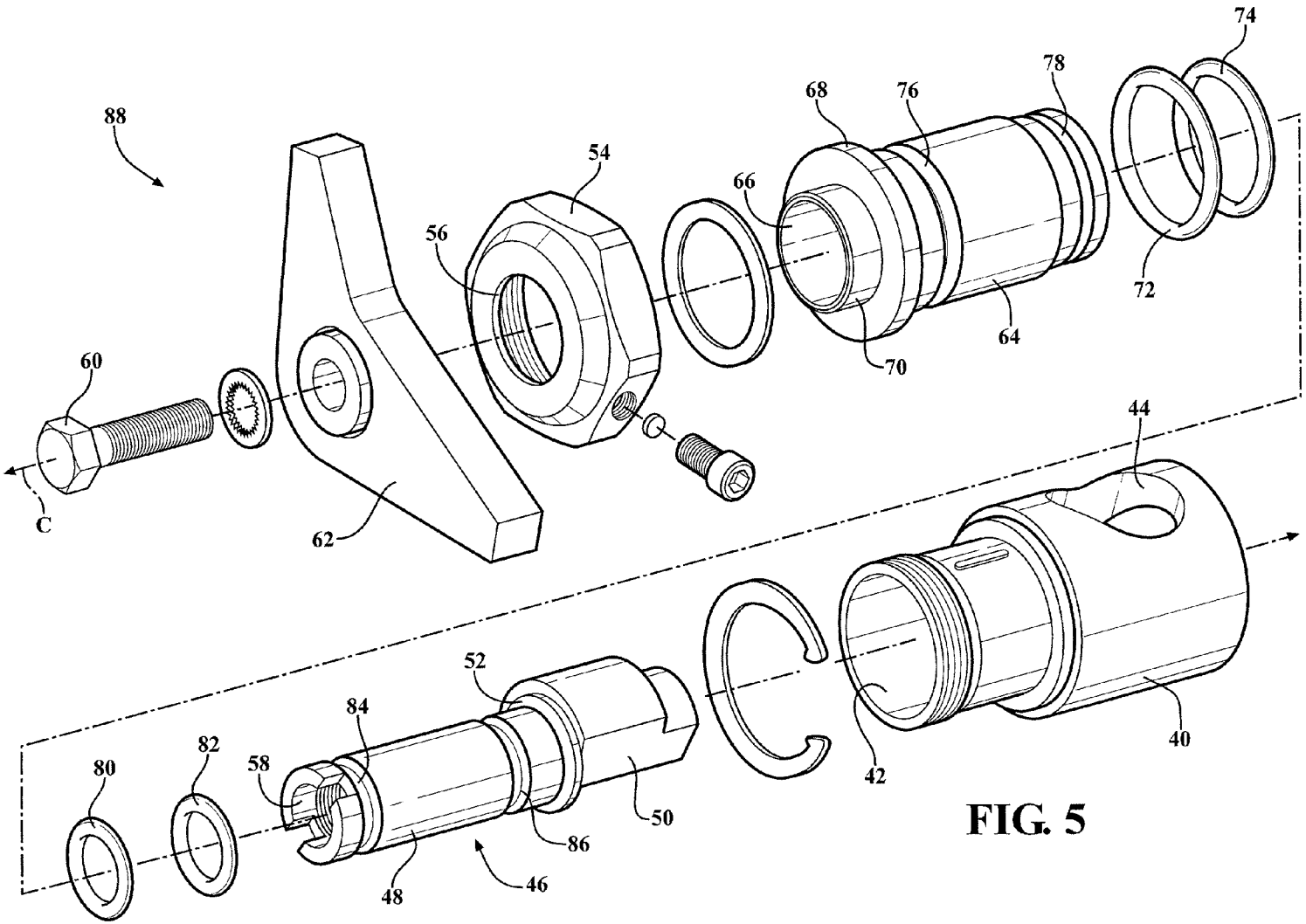
FIG. 5 is an exploded view of a cam apparatus.

Turning to FIGS. 4 and 5, the cam member 46 includes a shaft portion 48 and an eccentric portion 50 coupled to the shaft portion 48. The shaft portion 48 and the eccentric portion 50 concurrently move between the first and second positions. The shaft portion 48 defines a shaft outer diameter $OD_S$ and the eccentric portion 50 defines an eccentric outer diameter $OD_E$ greater than the shaft outer diameter $OD_S$. The third inner diameter $ID_3$ of the cam housing 40 is greater than the eccentric outer diameter $OD_E$ of the eccentric portion 50 for receiving the eccentric portion 50.

The eccentric portion 50 aligns with the filling valve 20 for moving the filling valve 20 between the filling and non-filling positions. More specifically, the eccentric portion 50 is disposed within the first aperture 42 and at least partially aligns with the second aperture 44 of the cam housing 40. The eccentric portion 50 presents an arcuate surface engaging a part of the filling valve 20 and more specifically, the arcuate surface engages the cap 28 of the filling valve 20. The eccentric portion 50 of the cam member 46 continuously engages the cap 28. It is to be appreciated that the eccentric portion 50 can be any suitable configuration to engage the cap 28 and move the filling valve 20 between the filling and non-filling positions.

The cam member 46 also includes a lip portion 52 disposed between the shaft and eccentric portions 48, 50 within the first aperture 42. In other words, the lip portion 52 couples the shaft and eccentric portions 48, 50 together. The lip portion 52 defines a lip outer diameter $OD_L$ greater than the shaft outer diameter $OD_S$. In addition, the lip outer diameter $OD_L$ is less than at least a portion of the eccentric outer diameter $OD_E$. Further, the lip outer diameter $OD_L$ is less than the second inner diameter $ID_2$ of the cam housing 40. The shaft portion 48, the lip portion 52, and the eccentric portion 50 can be integrally formed to each other or affixed to each other by any suitable method, such as welding, etc. Therefore, the shaft portion 48, the lip portion 52, and the eccentric portion 50 of the cam member 46 concurrently move between the first and second positions.

Figure 6:
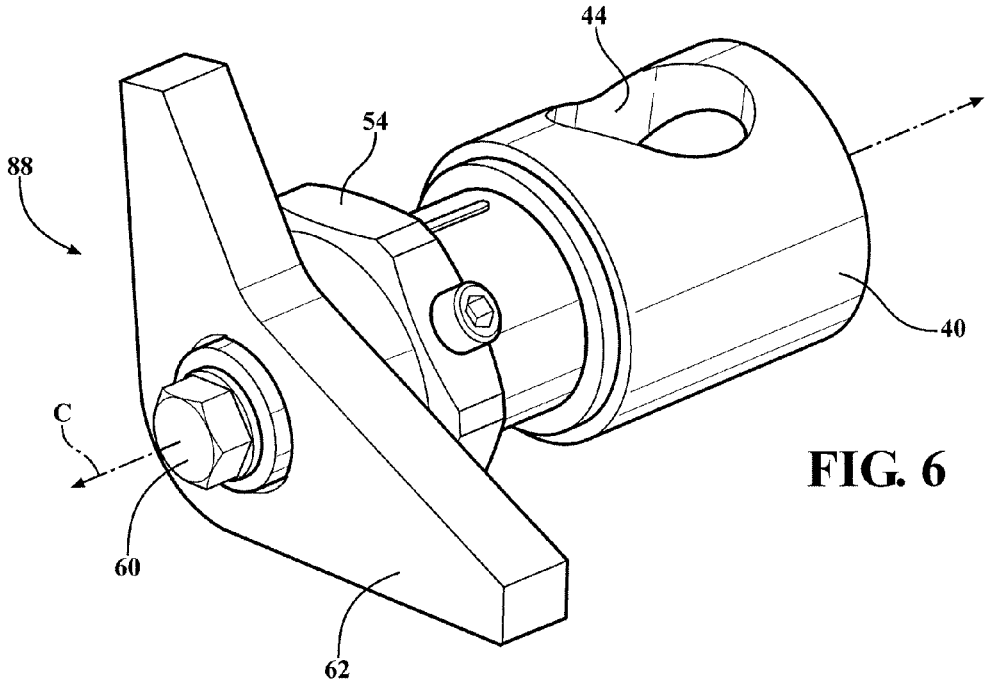
FIG. 6 is a perspective view of the cam apparatus.
Figure 7:
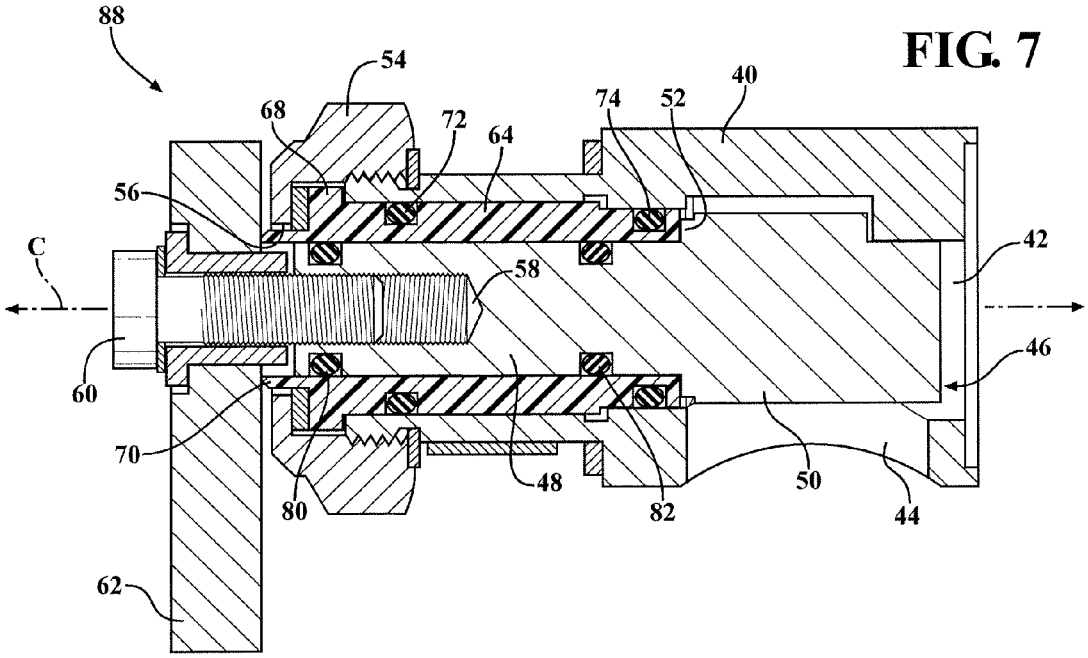
FIG. 7 is a cross-sectional view of the cam apparatus.

Referring to FIGS. 5-7, a nut 54 is secured to one end of the cam housing 40 for retaining the cam member 46 within the first aperture 42. The nut 54 defines an opening 56 which will be discussed further below. The shaft portion 48 of the cam member 46 also defines a bore 58 extending axially along the central axis C. A screw 60 is disposed through the opening 56 of the nut 54 and into the bore 58. More specifically, the screw 60 is secured to the shaft portion 48 of the cam member 46 such that the screw 60 moves concurrently with the cam member 46 between the first and second positions.

The assembly 10 also includes a lever 62 connected to the cam member 46 for concurrent movement with the cam member 46 to actuate the cam member 46 and the filling valve 20 between the filling and non-filling positions. The screw 60 is disposed through the lever 62 to connect the lever 62 to the cam member 46 such that the screw 60, the lever 62, and the cam member 46 move concurrently together between the first and second positions. The lever 62 selectively engages the arm affixed to the stanchions as the filling table rotates about the pivot axis. More specifically, the lever 62 is rotatable about the central axis C between an on-position in which the cam member 46 is in the first position and the filling valve 20 is in the filling position and an off-position in which the cam member 46 is in the second position and the filling valve 20 is in the non-filling position. The on-position is shown in FIGS. 1 and 2 and the off-position is shown in FIG. 3.

As best shown in FIGS. 4 and 7, the assembly 10 further includes a bearing sleeve 64 at least partially disposed within the first aperture 42 of the cam housing 40. The bearing sleeve 64 defines an orifice 66 axially along the central axis C for receiving the shaft portion 48 such that the bearing sleeve 64 is disposed between the shaft portion 48 and the cam housing 40. More specifically, the orifice 66 of the bearing sleeve 64 defines a bearing inner diameter $ID_B$ complementary to the shaft outer diameter $OD_S$ such that the bearing sleeve 64 receives the shaft portion 48 of the cam member 46. The bearing sleeve 64 abuts the lip portion 52 of the cam member 46 for preventing movement of the bearing sleeve 64 along the central axis C.

The bearing sleeve 64 is formed of a self-lubricating material for preventing frictional engagement between the cam housing 40 and the shaft portion 48 as the cam member 46 moves within the cam housing 40 and more specifically, as the cam member 46 rotates between the first and second positions. In other words, the bearing sleeve 64 prevents frictional wear between the cam housing 40 and the cam member 46 during movement/rotation.

The self-lubricating material of the bearing sleeve 64 is typically a plastic material and more typically a thermoplastic material. Suitable thermoplastic materials include, but are not limited to, semi-crystalline thermoplastic materials; such as polyethylene terephthalate, e.g. PET-P. In certain embodiments, the self-lubricating material is formed of Ertalyte® PET-P. Ertalyte® is commercially available from Quadrant. Other suitable plastic materials include nylon, such as Lauramid® and Nyaltron®; polyoxymethylene; phenolic composites; or combinations thereof. It is to be appreciated that other self-lubricating materials can also be used for the bearing sleeve 64.

In one embodiment, rotation of the cam member 46 about the central axis C also causes concurrent rotation of the bearing sleeve 64 about the central axis C. In another embodiment, the cam member 46 at least partially rotates about the central axis C independently of the bearing sleeve 64. In other words, the bearing sleeve 64 can remain stationary relative to the cam housing 40 during all or part of the rotation of the cam member 46.

The bearing sleeve 64 includes a flange 68 adjacent the cam housing 40 for preventing movement of the bearing sleeve 64 axially along the central axis C during operation. Typically, the flange 68 is sandwiched between the cam housing 40 and the nut 54 for preventing movement of the bearing sleeve 64 axially along the central axis C during operation. In other words, one end of the bearing sleeve 64 abuts the lip portion 52 of the cam member 46 and an other end of the bearing sleeve 64 is secured to the cam housing 40 through the flange 68 and the nut 54 such that movement of the bearing sleeve 64 axially along the central axis C is prevented. In one configuration, the flange 68 of the bearing sleeve 64 abuts the cam housing 40.

The bearing sleeve 64 further includes a rim 70 extending axially from the flange 68 along the central axis C. The rim 70 surrounds a portion of the orifice 66 with the rim 70 and the flange 68 spaced from the first aperture 42 of the cam housing 40. In other words, the rim 70 and the flange 68 are exposed outside the cam housing 40. At least a part of the rim 70 of the bearing sleeve 64 is disposed within the opening 56 of the nut 54 with the nut 54 surrounding the flange 68. It is to be appreciated that a segment of the rim 70 can extend through the opening 56 of the nut 54 such that the segment of the rim 70 is exposed outside of the nut 54.

In addition, the bearing sleeve 64 is removable from the shaft portion 48 during servicing. More specifically, when the screw 60, the lever 62, and the nut 54 are disassembled from the cam housing 40, the cam member 46 can be removed from the first aperture 42 of the cam housing 40. Once the cam member 46 is removed from the cam housing 40, the bearing sleeve 64 can be removed from the shaft portion 48 of the cam member 46. In other words, the bearing sleeve 64 can be slid away from the eccentric portion 50 and off the shaft portion 48 for easily servicing and/or replacing the cam member 48 and/or bearing sleeve 64.

The bearing sleeve 64 defines a first outer diameter $OD_1$ adjacent the flange 68. Also, the bearing sleeve 64 defines a second outer diameter $OD_2$ less than the first outer diameter $OD_1$ with the first outer diameter $OD_1$ disposed between the flange 68 and the second outer diameter $OD_2$. The first inner diameter $ID_1$ of the first aperture 42 of the cam housing 40 is complementary to the first outer diameter $OD_1$ of the bearing sleeve 64 for receiving the bearing sleeve 64. The second inner diameter $ID_2$ of the first aperture 42 of the cam housing 40 is complementary to the second outer diameter $OD_2$ of the bearing sleeve 64 for receiving the bearing sleeve 64.

The assembly 10 further includes a first seal 72 and a second seal 74 spaced from the first seal 72 with the first and second seals 72, 74 each engaging the bearing sleeve 64 and the cam housing 40 within the first aperture 42 during operation. More specifically, the bearing sleeve 64 defines a first recess 76 receiving the first seal 72 and the bearing sleeve 64 defines a second recess 78 receiving the second seal 74 with the first and second recesses 76, 78 spaced from each other. Typically, the first and second recesses 76, 78 encircle the bearing sleeve 64. The first seal 72 is disposed between the flange 68 of the bearing sleeve 64 and the second seal 74. Similarly, the first recess 76 is disposed between the flange 68 of the bearing sleeve 64 and the second recess 78. The first and second seals 72, 74 prevent leaking of the fluid between the bearing sleeve 64 and the cam housing 40. The first and second seals 72, 74 can be further defined as an o-ring or any other suitable seal. It is to be appreciated that only one recess 76, 78 and one seal 72, 74 can be utilized for preventing leaking of the fluid or more than two recesses 76, 78 and two seals 72, 74 can be utilized for preventing leaking of the fluid.

The assembly 10 also includes a third seal 80 and a fourth seal 82 spaced from the third seal 80 with the third and fourth seals 80, 82 each engaging the shaft portion 48 and the bearing sleeve 64 within the orifice 66. More specifically, the shaft portion 48 defines a first groove 84 receiving the third seal 80 and the shaft portion 48 defines a second groove 86 receiving the fourth seal 82 with the first and second grooves 84, 86 spaced from each other. Typically, the first and second grooves 84, 86 encircle the shaft portion 48. The fourth seal 82 is disposed between the lip portion 52 of the cam member 46 and the third seal 80. Similarly, the second groove 86 is disposed between the lip portion 52 of the cam member 46 and the first groove 84. In addition, the bore 58 of the shaft portion 48 of the cam member 46 is spaced from the first and second grooves 84, 86. The third and fourth seals 80, 82 prevent leaking of the fluid between the shaft portion 48 and the bearing sleeve 64. The third and fourth seals 80, 82 can be further defined as an o-ring or any other suitable seal. It is to be appreciated that only one groove 84, 86 and one seal 80, 82 can be utilized for preventing leaking of the fluid or more than two grooves 84, 86 and two seals 80, 82 can be utilized for preventing leaking of the fluid.

The assembly 10 further includes a cam apparatus 88 for the beverage filling machine which is generally shown in FIGS. 5-7. The cam apparatus 88 includes the cam housing 40, the cam member 46, the lever 62, and the bearing sleeve 64 as discussed above.

The operation of the cam apparatus 88 and the filling valve 20 will be discussed below for illustrative purposes only. When the lever 62 rotates to the on-position, the cam member 46 correspondingly rotates to the first position, and the filling valve 20 moves to the filling position. The eccentric portion 50 of the cam member 46 rotates to the first position and engages the cap 28 of the filling valve 20. The first spring 36 decompresses to move the cap 28 away from the valve stem 30. Referring to FIG. 1, with the cap 28 spaced from the valve stem 30, carbon dioxide ($CO_2$) is allowed to travel down the valve stem 30, through the vent tube 32 and into the container 12. The second spring 38 remains compressed and the valve seal 34 remains sealed to prevent fluid from flowing into the container 12. This step is commonly referred to as counter-pressure.

The container 12 continues to fill with carbon dioxide until the pressure between the container 12 and the tank begin to equalize. Referring to FIG. 2, once the pressure begins to equalizes, the second spring 38 decompresses and lifts the valve sleeve 26 and the valve seal 34 upwardly toward the cap 28 and the fluid begins to flow into the container 12. During this step, the lever 62 remains in the on-position, the cam member 46 remains in the first position, and the filling valve 20 remains in the filling position.

As the fluid fills the container 12, carbon dioxide and air travel up and out the vent tube 32 and the valve stem 30 and back into the tank. Carbon dioxide and air continue to travel out of the vent tube 32 and the valve stem 30 until the fluid covers a bottom of the vent tube 32. Referring to FIG. 3, once the fluid covers the bottom of the vent tube 32, the fluid stops flowing into the container 12. When the container 12 is full of fluid, the lever 62 rotates to the off-position, the cam member 46 correspondingly rotates to the second position, and the filling valve 20 moves to the non-filling position. The eccentric portion 50 of the cam member 46 rotates to the second position and engages the cap 28 of the filling valve 20 such that the cap 28 moves downwardly toward the valve stem 30. The first spring 36 is compressed and the cap 28 engages the valve stem 30. The second spring 38 is compressed and the valve sleeve 26 and the valve seal 34 move downwardly away from the cap 28 for re-sealing the valve seal 34 to prevent fluid from flowing into the container 12.

Many modifications and variations of the present invention are possible in light of the above teachings. The foregoing invention has been described in accordance with the relevant legal standards; thus, the description is exemplary rather than limiting in nature. Variations and modifications to the disclosed embodiment can become apparent to those skilled in the art and do come within the scope of the invention. Accordingly, the scope of legal protection afforded this invention can only be determined by studying the following claims.

What is claimed is:

1. A beverage filling assembly for filling a container with fluid, said assembly comprising:

a filling valve movable between a filling position for allowing fluid to flow into the container and a non-filling position for preventing fluid from flowing into the container;

a cam housing defining a first aperture axially along a central axis and a second aperture transverse to said central axis with said filling valve aligned with said second aperture;

a cam member rotatably disposed in said first aperture and having a shaft portion and an eccentric portion coupled to said shaft portion with said eccentric portion aligning with said filling valve for moving said filling valve between said filling and non-filling positions;

a lever connected to said cam member for concurrent movement with said cam member to actuate said cam member and said filling valve between said filling and non-filling positions; and a bearing sleeve defining an orifice axially along said central axis for receiving said shaft portion such that said bearing sleeve is partially disposed between said shaft portion and said cam housing with said bearing sleeve formed of a self-lubricating material for preventing frictional engagement between said cam housing and said shaft portion as said cam member moves within said cam housing;

said bearing sleeve includes a flange fixed to said bearing sleeve and disposed outside of said first aperture adjacent said cam housing for preventing movement of said bearing sleeve axially along said central axis during operation with said bearing sleeve and said flange being removable as a unit from said shaft portion during servicing.

2. A beverage filling assembly as set forth in claim 1 wherein said bearing sleeve defines a first outer diameter adjacent said flange and a second outer diameter less than said first outer diameter with said first outer diameter disposed between said flange and said second outer diameter.

3. A beverage filling assembly as set forth in claim 2 wherein said first aperture of said cam housing defines a first inner diameter complementary to said first outer diameter of said bearing sleeve for receiving said bearing sleeve.

4. A beverage filling assembly as set forth in claim 3 wherein said first aperture of said cam housing defines a second inner diameter less than said first inner diameter with said second inner diameter complementary to said second outer diameter of said bearing sleeve for receiving said bearing sleeve with said flange abutting said cam housing.

5. A beverage filling assembly as set forth in claim 1 wherein said bearing sleeve includes a rim fixed to said bearing sleeve and extending axially from said flange along said central axis such that said rim surrounds a portion of said orifice with said rim spaced from said first aperture of said cam housing, and with said bearing sleeve, said flange and said rim being removable as a unit from said shaft portion during servicing.

6. A beverage filling assembly as set forth in claim 1 wherein said shaft portion defines a shaft outer diameter and said orifice of said bearing sleeve defines a bearing inner diameter complementary to said shaft outer diameter such that said bearing sleeve receives said shaft portion.

7. A beverage filling assembly as set forth in claim 6 wherein said eccentric portion defines an eccentric outer diameter greater than said shaft outer diameter.

8. A beverage filling assembly as set forth in claim 1 further including at least one seal engaging said bearing sleeve and said cam housing within said first aperture and wherein said bearing sleeve defines at least one recess receiving said seal.

9. A beverage filling assembly as set forth in claim 1 further including at least one seal engaging said shaft portion and said bearing sleeve within said orifice and wherein said shaft portion defines at least one groove receiving said seal.

10. A beverage filling assembly as set forth in claim 1 wherein said self-lubricating material is further defined as Ertalyte® PET-P.

11. A cam apparatus for a beverage filling machine, said apparatus comprising:

a cam housing defining an aperture axially along a central axis;

a cam member disposed in said aperture and having a shaft portion with said cam member movable between a first position and a second position;

a lever connected to said cam member for concurrent movement with said cam member; and a bearing sleeve defining an orifice axially along said central axis for receiving said shaft portion such that said bearing sleeve is partially disposed between said shaft portion and said cam housing with said bearing sleeve formed of a self-lubricating material for preventing frictional engagement between said cam housing and said shaft portion as said cam member moves between said first and second positions;

said bearing sleeve includes a flange adjacent said cam housing for preventing movement of said bearing sleeve axially along said central axis during operation with said bearing sleeve being removable from said shaft portion during servicing;

wherein said bearing sleeve defines a first outer diameter adjacent said flange and wherein said bearing sleeve defines a second outer diameter less than said first outer diameter with said first outer diameter disposed between said flange and said second outer diameter.

12. A cam apparatus as set forth in claim 11 wherein said shaft portion defines a shaft outer diameter and said cam member includes an eccentric portion coupled to said shaft portion with said eccentric portion defining an eccentric outer diameter greater than said shaft outer diameter and wherein said orifice of said bearing sleeve defines a bearing inner diameter complementary to said shaft outer diameter such that said bearing sleeve receives said shaft portion.

13. A cam apparatus as set forth in claim 11 wherein said first aperture of said cam housing defines a first inner diameter complementary to said first outer diameter of said bearing sleeve for receiving said bearing sleeve and wherein said first aperture of said cam housing defines a second inner diameter less than said first inner diameter with said second inner diameter complementary to said second outer diameter of said bearing sleeve for receiving said bearing sleeve.

14. A beverage filling assembly for filling a container with fluid, said assembly comprising:

a filling valve movable between a filling position for allowing fluid to flow into the container and a non-filling position for preventing fluid from flowing into the container;

a cam housing defining a first aperture axially along a central axis and a second aperture transverse to said central axis with said filling valve aligned with said second aperture;

a cam member rotatably disposed in said first aperture and having a shaft portion and an eccentric portion coupled to said shaft portion with said eccentric portion aligning with said filling valve for moving said filling valve between said filling and non-filling positions;

a lever connected to said cam member for concurrent movement with said cam member to actuate said cam member and said filling valve between said filling and non-filling positions; and a bearing sleeve defining an orifice axially along said central axis for receiving said shaft portion such that said bearing sleeve is partially disposed between said shaft portion and said cam housing with said bearing sleeve formed of a self-lubricating material for preventing frictional engagement between said cam housing and said shaft portion as said cam member moves within said cam housing;

wherein said cam member includes a lip portion disposed between said shaft and eccentric portions within said first aperture with said shaft portion defining a shaft outer diameter and said lip portion defining a lip outer diameter greater than said shaft outer diameter, and said bearing sleeve abutting said lip portion when disposed about said shaft portion for preventing movement of said bearing sleeve along said central axis.

15. A beverage filling assembly as set forth in claim 14 wherein said orifice of said bearing sleeve defines a bearing inner diameter complementary to said shaft outer diameter such that said bearing sleeve receives said shaft portion.

16. A beverage filling assembly as set forth in claim 14 wherein said eccentric portion defines an eccentric outer diameter greater than said shaft outer diameter.

17. A beverage filling assembly as set forth in claim 14 wherein said bearing sleeve includes a flange fixed to said bearing sleeve and disposed outside of said first aperture adjacent said cam housing for further preventing movement of said bearing sleeve axially along said central axis during operation with said bearing sleeve and said flange being removable as a unit from said shaft portion during servicing.

18. A cam apparatus for a beverage filling machine, said apparatus comprising:

a cam housing defining an aperture axially along a central axis;

a cam member disposed in said aperture and having a shaft portion with said cam member movable between a first position and a second position;

a lever connected to said cam member for concurrent movement with said cam member; and a bearing sleeve defining an orifice axially along said central axis for receiving said shaft portion such that said bearing sleeve is partially disposed between said shaft portion and said cam housing with said bearing sleeve formed of a self-lubricating material for preventing frictional engagement between said cam housing and said shaft portion as said cam member moves between said first and second positions;

wherein said cam member includes a lip portion disposed between said shaft and eccentric portions within said first aperture with said shaft portion defining a shaft outer diameter and said lip portion defining a lip outer diameter greater than said shaft outer diameter, and said bearing sleeve abutting said lip portion when disposed about said shaft portion for preventing movement of said bearing sleeve along said central axis.

19. A cam apparatus as set forth in claim 18 wherein said orifice of said bearing sleeve defines a bearing inner diameter complementary to said shaft outer diameter such that said bearing sleeve receives said shaft portion.

20. A cam apparatus as set forth in claim 18 wherein said eccentric portion defines an eccentric outer diameter greater than said shaft outer diameter.

21. A cam apparatus as set forth in claim 18 wherein said bearing sleeve includes a flange fixed to said bearing sleeve and disposed outside of said first aperture adjacent said cam housing for further preventing movement of said bearing sleeve axially along said central axis during operation with said bearing sleeve and said flange being removable as a unit from said shaft portion during servicing.

22. A cam apparatus for a beverage filling machine, said apparatus comprising:

a cam housing defining an aperture axially along a central axis;

a cam member disposed in said aperture and having a shaft portion with said cam member movable between a first position and a second position;

a lever connected to said cam member for concurrent movement with said cam member; and a bearing sleeve defining an orifice axially along said central axis for receiving said shaft portion such that said bearing sleeve is partially disposed between said shaft portion and said cam housing with said bearing sleeve formed of a self-lubricating material for preventing frictional engagement between said cam housing and said shaft portion as said cam member moves between said first and second positions;

said bearing sleeve includes a flange fixed to said bearing sleeve and disposed outside of said first aperture adjacent said cam housing for preventing movement of said bearing sleeve axially along said central axis during operation with said bearing sleeve and said flange being removable as a unit from said shaft portion during servicing.

23. A cam apparatus as set forth in claim 22 wherein said bearing sleeve defines a first outer diameter adjacent said flange and a second outer diameter less than said first outer diameter with said first outer diameter disposed between said flange and said second outer diameter.

24. A cam apparatus as set forth in claim 22 wherein said bearing sleeve includes a rim fixed to said bearing sleeve and extending axially from said flange along said central axis such that said rim surrounds a portion of said orifice with said rim spaced from said first aperture of said cam housing, and with said bearing sleeve, said flange and said rim being removable as a unit from said shaft portion during servicing.

25. A cam apparatus for a beverage filling machine, said apparatus comprising:

a cam housing defining an aperture axially along a central axis;

a cam member disposed in said aperture and having a shaft portion defining at least one groove with said cam member movable between a first position and a second position;

a lever connected to said cam member for concurrent movement with said cam member;

a bearing sleeve defining an outer surface with at least one recess formed within said outer surface, and an inner surface defining an orifice axially along said central axis for receiving said shaft portion such that said bearing sleeve is partially disposed between said shaft portion and said cam housing with said bearing sleeve formed of a self-lubricating material for preventing frictional engagement between said cam housing and said shaft portion as said cam member moves between said first and second positions;

at least one outer seal disposed within said recess of said bearing sleeve and engaging said cam housing within said first aperture for providing a seal between said bearing sleeve and said cam housing; and at least one inner seal disposed within said groove of said shaft portion and engaging said bearing sleeve within said orifice for providing a seal between said shaft portion and said bearing sleeve.

26. A cam apparatus as set forth in claim 25 wherein said bearing sleeve includes a flange fixed to said bearing sleeve and disposed outside of said first aperture adjacent said cam housing for preventing movement of said bearing sleeve axially along said central axis during operation with said bearing sleeve and said flange being removable as a unit from said shaft portion during servicing.

27. A cam apparatus as set forth in claim 26 wherein said bearing sleeve defines a first outer diameter adjacent said flange and a second outer diameter less than said first outer diameter with said first outer diameter disposed between said flange and said second outer diameter.

* * * * *